US006103104A

United States Patent [19]

Gupta

[11] Patent Number: 6,103,104

[45] Date of Patent: Aug. 15, 2000

[54] MULTI-STAGE HYDROPROCESSING OF MIDDLE DISTILLATES TO AVOID COLOR BODIES

[75] Inventor: Ramesh Gupta, Berkeley Heights, N.J.

[73] Assignee: Exxon Research and Engineering Company, Florham Park, N.J.

[21] Appl. No.: 09/074,268

[22] Filed: May 7, 1998

[51] Int. Cl.[7] ..... C10G 45/08

[52] U.S. Cl. ..... 208/210; 208/213; 208/216 R; 208/217; 208/254 H; 208/89; 208/58; 208/59

[58] Field of Search ..... 208/210, 213, 208/216 R, 217, 254 H, 89, 58, 59

[56] References Cited

U.S. PATENT DOCUMENTS

| | | | |
|---|---|---|---|
| 2,952,626 | 9/1960 | Kelley et al. | 208/210 |
| 3,728,249 | 4/1973 | Antezana et al. | 208/57 |
| 3,915,841 | 10/1975 | Murphy, Jr. et al. | 208/89 |
| 4,021,330 | 5/1977 | Satchell | 208/89 |
| 4,243,519 | 1/1981 | Schorfheide | 208/210 |
| 4,801,373 | 1/1989 | Corman et al. | 208/210 |
| 5,110,444 | 5/1992 | Haun et al. | 208/89 |
| 5,183,556 | 2/1993 | Reilly et al. | 208/57 |
| 5,292,428 | 3/1994 | Harrison et al. | 208/208 R |
| 5,316,658 | 5/1994 | Ushio et al. | 208/216 R |
| 5,670,116 | 9/1997 | Gupta et al. | 422/191 |
| 5,705,052 | 1/1998 | Gupta | 208/57 |
| 5,707,511 | 1/1998 | Markley et al. | 208/210 |
| 5,720,872 | 2/1998 | Gupta | 208/57 |

*Primary Examiner*—Walter D. Griffin
*Assistant Examiner*—Nadine Preisch
*Attorney, Agent, or Firm*—Henry E. Naylor; Gerard J. Hughes

[57] ABSTRACT

A process for hydroprocessing middle distillate petroleum streams in two temperature stages. The feedstream is hydroprocessed in two or more first temperature stages operated at a temperature from about 360° C. to about 450° C. The reaction product of the first temperature stage(s) is quenched to a temperature from about 260° C. to about 350, stripped of $H_2S$, $NH_3$ and other dissolved gases, then sent to the second temperature stage which is operated at said quenched temperature range. The product from the second temperature stage is also stripped of dissolved gases. Color bodies produced in the higher temperature first stage are hydrogenated in the last stage.

10 Claims, 1 Drawing Sheet

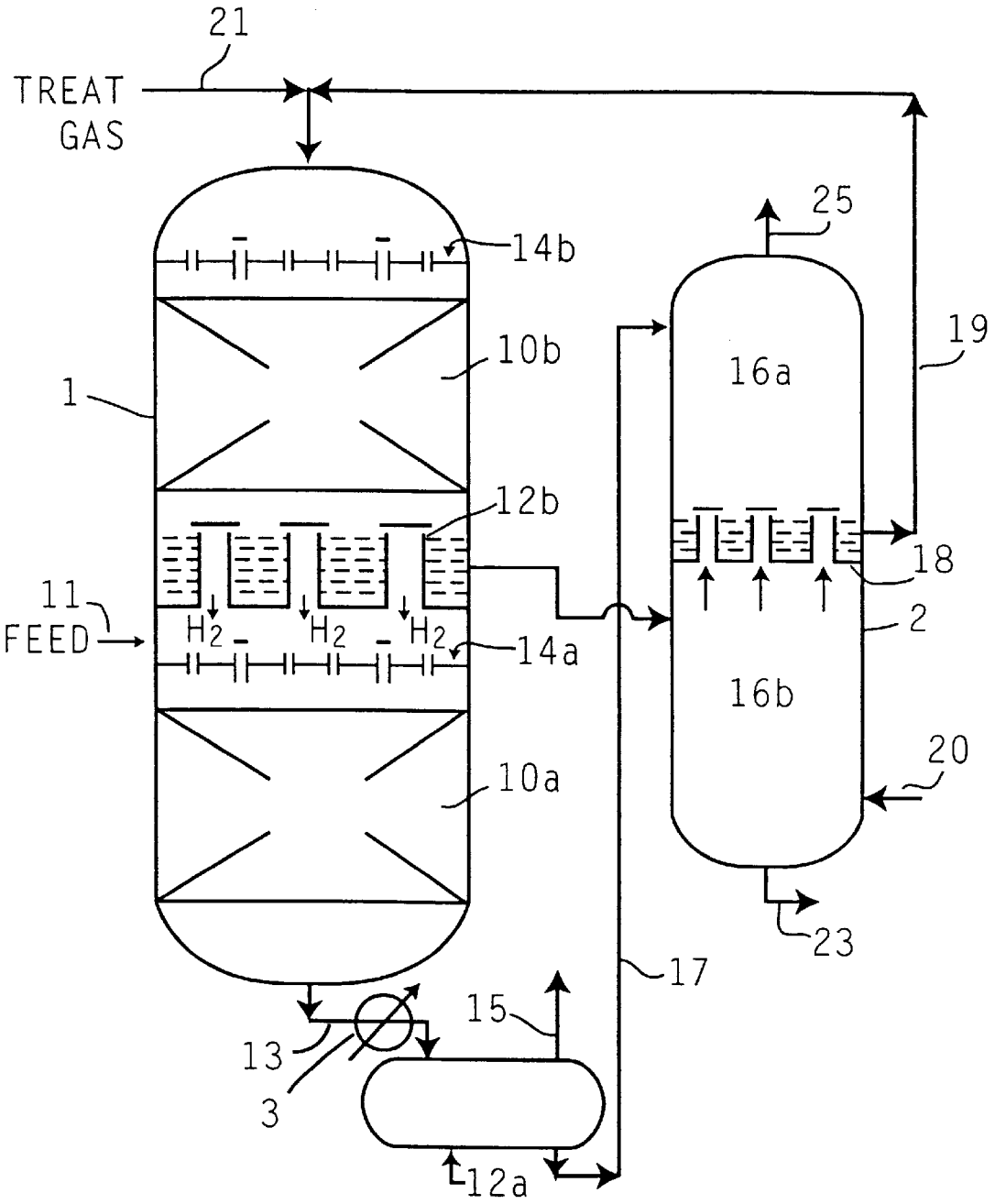
21
TREAT
GAS
14b
10b
1
12b
11
FEED
H2
H2
H2
14a
10a
25
16a
19
18
2
16b
20
23
17
15
13
3
12a

MULTI-STAGE HYDROPROCESSING OF MIDDLE DISTILLATES TO AVOID COLOR BODIES

FIELD OF THE INVENTION

The present invention relates to a process for hydroprocessing middle distillate petroleum streams in two temperature stages. The feedstream is hydroprocessed in two or more first temperature stages operated at a temperature from about 360° C. to about 450° C. The reaction product of the first temperature stage(s) is quenched to a temperature from about 260° C. to about 350° C., stripped of $H_2S$, $NH_3$ and other dissolved gases, then sent to the second temperature stage which is operated at said quenched temperature range. The product from the second temperature stage is also stripped of dissolved gases. Color bodies produced in the higher temperature first stage are hydrogenated in the last stage.

BACKGROUND OF THE INVENTION

Petroleum refiners have a continuing need for improved methods for removing components from their products, which have the potential of being harmful to the environment. Fuel products, such as diesel fuels, or middle distillates, are representative of those products which must meet ever increasing governmental restrictions with respect to the level of heteroatoms, such as sulfur and nitrogen components. For example, feedstocks for producing diesel fuels will typically contain about 1 to 2 wt. % or more sulfur, but the final fuel product, to meet governmental requirements, cannot have more than about 0.05 wt. %, and in the not too distant future, no more than about 0.005 wt. % sulfur is likely.

While high severity processing can reduce the level of sulfur and nitrogen components to 0.05 wt. % or less, the high temperatures used in such processing produces a fuel with poor color qualities. This is primarily because undesirable reactions, such as condensation and dehydrogenation reactions occur at high temperatures, resulting in components which are dark in color and which are extremely difficult to remove.

Much work is being done to develop more active catalysts and improved process designs to meet the demand for middle distillates which are low in sulfur and nitrogen, but which still meet the ASTM color requirements for the final fuel products. Various process scenarios have been suggested to reduce the level of heteroatoms in middle distillates, with or without maintaining good color quality. For example, Japanese Patent Laid-Open Application No.3-86793 teaches a two-step hydrotreating process for the production of a diesel gas oil having a sulfur content of 0.2 wt. % by weight or lower. The first step requires a temperature in the range of about 280° C. to about 370° C. and pressures from about 10 to 40 kg/cm$^2$. The second step requires a temperature in the range of about 150° C. to about 325° C. and similar pressures as the first step. Such a two-step process has difficulty producing products that are low enough in sulfur and which meet acceptable color specifications.

Also, U.S. Pat. No. 4,755,280 teaches a two-step hydrotreating process for improving the color and oxidation stability of hydrocarbon compounds wherein an Fe-type catalyst is employed in the second step. However, it is known that the hydrotreating activity of Fe-type catalysts is easily poisoned with hydrogen sulfide. Therefore, the amount of sulfur and nitrogen compounds present in the feedstock to be fed to the second step must be lowered to such uneconomical levels as 10 wppm.

Further, U.S. Pat. No. 3,841,995 proposes a two-step hydrotreating process for the improvement of the color and odor of hydrocarbon compounds. However, in the process a noble metal catalyst, such as a Pt catalyst, is used in the second step, thus, the hydrotreating activity of the catalyst is readily poisoned by sulfur components.

European Pat. Application 0523679 A2 teaches a two-step process for producing low-sulfur diesel gas oil with good color properties. The first step is conducted at a temperature from about 350° C. to about 450° C., and a pressure of about 45 to 100 kg/cm$^2$ in the presence of a hydrotreating catalyst and a the second step is conducted at a temperature from about 200° C. to about 300° C. and a pressure of about 45 to 100 kg/cm$^2$.

Other process configurations include the use of multiple reaction stages, either in a single reaction vessel, or in separate reaction vessels. More sulfur sensitive catalysts can be used in downstream stages as the level of heteroatom components becomes successively lower. European Pat. Application 93200165.4 teaches a two-stage hydrotreating process performed in a single reaction vessel, but there is no suggestion of a unique stripping arrangement for the liquid reaction stream from each reaction zone, and there is no suggestion of quenching the effluents from the first stage prior to hydroprocessing in the second stage.

While there is a substantial amount of art relating to reducing the heteroatom content of distillate feedstocks, there still remains a need in the art for improved processes that can produce middle distillates low in heteroatoms and yet within acceptable color specifications.

SUMMARY OF THE INVENTION

In accordance with the present invention, there is provided a process for removing heteroatoms from a heteroatom containing middle distillate feedstreams, which process comprises:

(a) hydrotreating said feedstream in a first temperature stage in the presence of a treat gas comprised of once-through hydrogen-containing treat gas and recycle treat gas from a downstream temperature stage wherein said first temperature stage contains a hydrotreating catalyst, said first temperature stage being operated at hydrotreating conditions that includes a temperatures in the range of about 360° C. to about 450° C., thereby producing a reaction product comprised of a liquid component and a vapor component;

(b) quenching said reaction product to a temperature from about 260° C. to about 350° C.;

(c) separating the liquid component from said vapor component;

(d) stripping said liquid component of dissolved gaseous material in a first stripping zone;

(e) hydrotreating said stripped liquid component of step (d) in the second temperature stage, which reaction stage contains a hydrotreating catalyst and is operated in the presence of fresh hydrogen-containing gas, at hydrotreating conditions, which includes a temperature from about 260° C. to about 350° C., thereby resulting in a reaction product comprised of a liquid component and a vapor component;

(f) separating said liquid component from said vapor component; and (g) stripping said liquid component of dissolved gaseous material in a second stripping zone.

In a preferred embodiment of the present invention there are two or more second temperature stages and the second temperature stage or stages contains a catalyst comprised of NiMo on an inert refractory support material.

BRIEF DESCRIPTION OF THE FIGURES

The FIGURE hereof is a reaction vessel used in the practice of the present invention showing two reaction stages in a single vessel and a stripping vessel having two stripping zones.

DETAILED DESCRIPTION OF THE INVENTION

Feedstreams suitable for hydroprocessing in accordance with the present invention are those referred to in the art as "middle distillates", which usually contain undesirable heteroatoms, such as sulfur and nitrogen. Such streams are typically those boiling in the range from about 150° C. to about 400° C. and are typically obtained by distillation of crude oils, distillates obtained by fractionation of fluid catalytic cracking products, distillates obtained by fractionation of thermal cracking oils, and mixtures thereof. Non-limiting examples of such feeds include diesel fuels, jet fuels, and heating oils. The undesirable level of heteroatoms in middle distillates must be removed to meet modern environmental standards without adversely affecting the color of the final fuel product. The process of the present invention produces a fuel product, preferably a distillate fuel product, that is both low in heteroatom components and that also meets color requirements. This is done without the need for unduly high pressures that add considerably to the costs of the process.

The process of the present invention can be better understood by a description of a preferred embodiment illustrated by FIG. 1 hereof, which shows a single reactor with two temperature stages 10*a* and 10*b*. Miscellaneous reaction vessel internals, valves, pumps, thermocouples, and heat transfer devices etc. are not shown in either figures for simplicity. Downstream of each reaction stage is a gas/liquid separation means 12*a* and 12*b*. Upstream of gas/liquid separation means 12*a* the product stream from first temperature stage is quenched, represented by 3. There is also provided a flow distributor means 14*a* and 14*b* upstream of each reaction stage. Stripping vessel 2 contains two stripping zones 16*a* and 16*b* and gas/liquid separator means 18. The stripping zones need not be in a single vessel. Separate vessels can be used for each stripping stage as long as each stripping zone is used to strip gaseous impurities from the reaction product from only one temperature stage.

The stripping vessel is operated in countercurrent mode wherein upflowing stripping gas, preferably steam, is introduced into the stripping vessel via line 20 and passes upwardly through both stripping zones as liquid reaction product flows downwardly through the respective stripping zone. The counter flowing stripping gas aids in stripping the downflowing liquid of dissolved gaseous impurities, such as $H_2S$ and $NH_3$, which are considered undesirable in most fuel products. It is preferred that the stripping zones contain a suitable solid stripping medium that will enhance the stripping capacity of the stripping zone. Preferred stripping mediums are those with a high enough surface area to enhance the separation of dissolved gases from liquid. Non-limiting examples of suitable stripping mediums include trays as well as packed beds of materials such as conventional structured packings well known to those having ordinary skill in the hydroprocessing art.

The process of the present invention is practiced, with respect to FIG. 1, by feeding the middle distillate feedstock above the catalyst bed of first temperature stage 10*a* via line 11. This first temperature stage is operated at a temperature from about 360° C. to about 450° C. It is preferred that the catalyst be in the reactor as a fixed bed, although other types of catalyst arrangements can be used, such as slurry or ebullating beds. The feedstock enters the reaction vessel and is distributed, with a treat gas, along the top of the catalyst bed of reaction stage 10*a* by use of distributor means 14*a* where it then passes through the bed of hydrotreating catalyst and undergoes the intended reaction, which includes hydrogenation of saturates and the removal of sulfur and nitrogen species from the feedstock by converting them to gaseous products, such as $H_2S$ and $NH_3$. The type of liquid distribution means is believed not to limit the practice of the present invention, but a tray arrangement is preferred, such as sieve trays, bubble cap trays, or trays with spray nozzles, chimneys, tubes, etc.

Reaction products and downflowing treat gas exit the reaction vessel via line 13 and are quenched to a temperature from about 260° C. to about 350° C. This quenching aids in the separation of the mid distillate liquid from the treat gas in separator 12*a* as well as providing a more desirable process environment for hydrogenating off-spec color components and not producing additional undesirable color components. That is, the lower temperature second reaction stage is desirable because the feedstream entering this second temperature stage is processed in a low $H_2S$ and $NH_3$ environment at a relatively lower temperature that is conducive to hydrogenating color bodies. A vapor phase effluent fraction is drawn off separator 12*a* via line 15. The vapor phase effluent fraction can be collected, but it is preferred that at least a portion of it be sent for recycle. The vapor phase stream is preferably scrubbed to remove contaminants, such as $H_2S$ and $NH_3$, and compressed (not shown) prior to recycle. The liquid reaction product is fed to stripping stage 16*a* via line 17 where it comes into contact with upflowing stripping gas, such as steam. It is preferred that the stripping stage contain a stripping medium, such as packing, or trays, as previously mentioned to provide increased surface area for contacting between the liquid and the stripping gas. Stripped liquid collects in the gas/liquid separator means 18 and is drawn off via line 19 and fed, with a suitable hydrogen-containing treat gas via line 21, into reaction vessel 1 to reaction stage 10*b* where it is passed through distributor means 14*b*. The feedstream, at this point, contains substantially less undesirable species, particularly sulfur and nitrogen species.

Both downflowing treat gas and downflowing stripped liquid from the first reaction stage pass through the bed of catalyst in reaction stage 10*b* where the stripped liquid reaction product undergoes the intended hydrotreating reaction. The catalyst in this catalyst bed may be the same or different catalyst than the catalyst in the first temperature stage. The catalyst is this second stage can be a high performance catalyst, which otherwise can be more sensitive to heteroatom poisoning because of the lower level of heteroatoms in the treated feedstream, as well as low levels of the heteroatom species $H_2S$ and $NH_3$ in the treat gas. Liquid reaction product from second reaction stage 10*b* is separated via gas/liquid separator means 12*b* and passed to second stripping zone 16*b* where it flows downward and countercurrent to upflowing stripping gas. Stripped liquid from stripping zone 16*b* exits the stripping vessel via line 23. The gaseous components that are stripped from the liquid reaction product from both stripping zones exit the stripping vessel via line 25. A portion of the vapor effluent exiting line 25 can also be condensed and returned to the stripping vessel (not shown).

There may be situations when somewhat higher levels of heteroatoms can be tolerated in the downstream reaction stage. For example, the catalyst in the downstream reaction stage may be relatively tolerant to small amounts of $H_2S$ and $NH_3$ in the stream to be treated in that reaction stage. In such cases, it may be desirable to use separators, or flash drums, in place of strippers wherein the product stream is flashed and a vapor fraction drawn off overhead and the liquid fraction collected below. The liquid fraction will contain somewhat higher levels of $H_2S$ and $NH_3$ than if the fraction was derived from a stripper. It is within the scope of the present invention to use multiple separate steps or devices instead of a single stripping stage.

It is preferred that the hydrotreating catalyst in the first temperature stage contain a Co—Mo on a refractory support catalyst and a downstream reaction stage contain a Ni—Mo on a refractory support catalyst. The term "hydrotreating" as used herein refers to processes wherein a hydrogen-containing treat gas is used in the presence of a suitable catalyst, which is primarily active for the removal of heteroatoms, such as sulfur, and nitrogen, and for some hydrogenation of aromatics. Suitable hydrotreating catalysts for use in the present invention are any conventional hydrotreating catalyst and includes those which are comprised of at least one Group VIII metal, preferably Fe, Co and Ni, more preferably Co and/or Ni, and most preferably Co; and at least one Group VI metal, preferably Mo and W, more preferably Mo, on a high surface area support material, such as alumina. Other suitable hydrotreating catalysts include zeolitic catalysts, as well as noble metal catalysts where the noble metal is selected from Pd and Pt. It is within the scope of the present invention that more than one type of hydrotreating catalyst be used in the same reaction vessel. The Group VIII metal is typically present in an amount ranging from about 2 to 20 wt. %, preferably from about 4 to 12 wt. %. The Group VI metal will typically be present in an amount ranging from about 5 to 50 wt. %, preferably from about 10 to 40 wt. %, and more preferably from about 20 to 30 wt. %. All metals weight percents are on support. By "on support" we mean that the percents are based on the weight of the support. For example, if the support were to weigh 100 g. then 20 wt. % Group VIII metal would mean that 20 g. of Group VIII metal was on the support.

The term "hydrogen-containing treat gas" means a treat gas stream containing at least an effective amount of hydrogen for the intended reaction. The treat gas stream introduced to the reaction vessel will preferably contain at least about 50 vol. %, more preferably at least about 75 vol. % hydrogen. It is preferred that the hydrogen-containing treat gas be make-up hydrogen-rich gas, preferably hydrogen.

Depending on the nature of the feedstock and the desired level of upgrading, more than one temperature zone may comprise the first and/or second temperature stages. By more than one temperature zone we mean that each temperature stage, within the given temperature range for that temperature stage, may contain more than one zone which contains hydrotreating catalyst and which is operated at the same or different temperatures, as long as the temperature is within the temperature range for that stage. For example, two zones may be employed in the first temperature stage, wherein each zone is operated at hydrotreating conditions, including temperatures in the range of about 360° C. to about 450° C. Each zone in the first temperature stage will contain a hydrotreating catalyst, as previously described. The second temperature stage, which is operated in the temperature range of about 260° C. to about 350° C., may also contain two or more temperature zones. That is, there may be two or more reaction zones, containing hydrotreating catalyst operated in the temperature range of said temperature stage. It is preferred that the catalyst of this second temperature stage be a NiMo supported hydrotreating catalyst.

What is claimed is:

1. A process for removing heteroatoms from middle distillate feedstreams having a first heteroatom amount, which process comprises:

(a) hydrotreating said feedstream in a first temperature stage in the presence of a treat gas comprised of once-through hydrogen-containing treat gas and recycle treat gas from a downstream temperature stage wherein said first temperature stage contains a hydrotreating catalyst, said first temperature stage being operated at hydrotreating conditions that includes a temperatures in the range of about 360° C. to about 450° C., thereby producing a reaction product comprised of a liquid component and a vapor component;

(b) quenching said reaction product to a temperature from about 260° C. to about 350° C;

(c) separating the liquid component from said vapor component;

(d) stripping said liquid component of dissolved gaseous material in a first stripping zone in order to provide the liquid component with a second heteroatom amount lower than the first heteroatom amount;

(e) hydrotreating said stripped liquid component of step (d) in the second temperature stage, which reaction stage contains a hydrotreating catalyst and is operated in the presence of fresh hydrogen-containing gas, at hydrotreating conditions, which includes a temperature from about 260° C. to about 350° C., thereby resulting in a reaction product comprised of a liquid component and a vapor component;

(f) separating said liquid component from said vapor component; and (g) stripping said liquid component of dissolved gaseous material in a second stripping zone.

2. The process of claim 1 wherein there are two or more temperature zones in the first temperature stage.

3. The process of claim 2 wherein all of the temperature stages are in a single vessel.

4. The process of claim 1 wherein there are two or more temperature zones in the second temperature stage.

5. The process of claim 4 wherein all of the temperature stages are in a single vessel.

6. The process of claim 1 wherein the hydrotreating catalyst for all of the temperature stages is comprised of at least one metal from Group VIII and at least one metal from Group VI of the Periodic Table of the Elements, said metals on an inorganic refractory support.

7. The process of claim 6 wherein the Group VIII metal is selected from the group consisting of a noble metal, Fe, Co and Ni, and the Group VI metal is selected from Mo and W.

8. The process of claim 7 wherein the catalyst of the first temperature stage is comprised of Co and Mo on an inorganic refractory support material, and the catalyst of the second temperature stage is comprised of Ni and Mo on an inorganic refractory support.

9. The process of claim 1 wherein at least one of the stripping zones contains a stripping medium that enhances the removal of dissolved gasses comprising $H_2S$ and $NH_3$ from a liquid.

10. The process of claim 1 wherein more than one stripping zone is in the same vessel.

* * * * *